United States Patent [19]

Hodak

[11] Patent Number: 4,819,681

[45] Date of Patent: Apr. 11, 1989

[54] APPARATUS AND METHOD FOR DRAINING A SWIMMING POOL COVER

[76] Inventor: Frank J. Hodak, E. Cruikshank Rd., Valencia, Butler County, Pa. 16059

[21] Appl. No.: 257,396

[22] Filed: Oct. 13, 1988

[51] Int. Cl.[4] ..... E03B 9/00; E03B 11/00

[52] U.S. Cl. ..... 137/1; 4/498; 137/312; 222/108

[58] Field of Search ..... 4/498, 499, 503, 507; 137/312, 313, 314; 220/219, 227, 108

[56] References Cited

U.S. PATENT DOCUMENTS

| | | | |
|---|---|---|---|
| 1,057,654 | 4/1913 | Menzl | 137/314 |
| 3,184,764 | 5/1965 | West | 4/498 |
| 3,337,418 | 8/1967 | Halacy, Jr. | 137/312 |
| 4,313,457 | 2/1982 | Cliff | 137/312 |
| 4,318,421 | 3/1982 | Ward | 4/498 |
| 4,450,855 | 5/1984 | Hills | 137/312 |
| 4,561,134 | 12/1985 | Mathews | 4/498 |
| 4,633,899 | 1/1987 | Lord | 137/312 |

*Primary Examiner*—George L. Walton

*Attorney, Agent, or Firm*—Webb, Burden Ziesenheim & Webb

[57] ABSTRACT

A method and apparatus for draining a swimming pool cover includes upper and lower flanged members having a central drain passage for sealably fitting around a hole formed in the pool cover. A drain tube upwardly extends from the upper flange and communicates with the passage thereof. An elbow fitting or the like communicates at one end with the passage in the lower flange and at another end with a flexible conduit. The conduit extends from the elbow fitting for connection to a conventional return water port fitting located at the pool sidewall. As water accumulates on the cover to a predetermined depth, the excess water drains into the drain tube and travels through the flexible conduit to exit the pool at the sidewall port fitting. A perforated drain closure member is also preferably employed around the drain tube to prevent debris blockage and to provide for adjustably regulating the height and weight of water stored on the cover for hold-down purposes.

12 Claims, 2 Drawing Sheets

APPARATUS AND METHOD FOR DRAINING A SWIMMING POOL COVER

BACKGROUND OF THE INVENTION

My invention relates generally to swimming pool covers and more particularly to devices and method for draining pool covers of the flexible plastic, water-impervious type.

Heretofore, it has been common practice to place a water-impervious permanent cover over the top surface of a swimming pool during the off-season, winter months to prevent leaves and other wind-blown debris from entering the water stored in the pool during the dormant period. Water is generally left in swimming pools, both in above-ground and in-ground designs, during the winter period for structural reasons, or for water conservation purposes. In some pool designs it is necessary to keep water in the pool to prevent sidewall collapse due to high ground water loading on the exterior of the sidewalls. Suffice it to say that it is quite common to employ a vinyl or other flexible plastic water-impervious cover over the pool water during the dormant months in most pool designs for the purpose of keeping foreign objects and other debris from accumulating therein during this period. Naturally, clean-up and pool preparation in the spring is made much easier when such debris is not present to contaminate the stored pool water.

A major problem encountered in the use of known flexible plastic pool covers results from the excess water which has accumulated on the top surface of the cover during the covered period. In use, a pool cover overlaps the pool perimeter and is anchored or affixed around the perimeter in a known manner such that the cover is permitted to sag somewhat down into the pool to rest on the water surface in the center area of the pool. A small, controlled depth of water on the top surface of the pool cover is desirable to provide a natural weight or anchor on a central area thereof in order to prevent whipping and tearing of the cover by wind. Unfortunately, as rain water and/or melted snow water accumulates on the cover over the winter months, the volume of water stored on the cover will increase to considerable levels. It is not at all uncommon for the pool owner to encounter an extremely great weight of water on the cover when the pool is ready to be re-opened in the spring. In some cases, the cover may tear under this great weight during the winter months. Commonly mixed with the collected volume of water on the cover is an assortment of decayed leaves, twigs and other accumulated debris, even sometimes including drowned animals, which may have fallen into the trapped water during the winter months.

Quite obviously it is desirable to keep such accumulated debris from entering the relatively clean pool water stored beneath the cover, but this is generally not possible unless the large volume of water on top of the cover is first removed. If the excess accumulated water is not drained by pumping or bailing prior to removing the cover, it is not uncommon that the weight of the accumulated water may tear the cover. Also, it is not uncommon that accumulated debris will flow over the cover edges into the clean stored pool water to contaminate the stored pool water while the cover is being removed.

The above problems associated with excess water accumulating on the surface of a pool cover during the winter months and subsequent tearing of the cover are eliminated by my invention. My invention provides an effective, yet inexpensive and easily installed drain device to continuously drain water from the cover. My invention further provides a pool cover drain device which maintains a constant volume of water of predetermined depth on the cover while continuously draining excess water accumulating above the predetermined desired level. In this manner a volume of water, of a predetermined weight, is maintained on the cover to prevent wind whipping damage to the cover which might otherwise occur if the cover were completely unweighted or insufficiently weighted. Still further, my invention provides a pool cover drain device which includes a vertically adjustable drain head closure which permits a variable depth of water to be accumulated on the cover to accommodate pool covers of various surface areas, which require varying weights of water for surface hold-down purposes. Thus for large surface area pool covers, the drain closure head is adjusted upwardly to permit a greater depth of water to accumulate thereon for weighting purposes.

Further, my invention provides a drainage device for pool covers suitable for use on both above-ground and in-ground pools which drains accumulated water through an existing pool sidewall port of the pool.

SUMMARY OF THE INVENTION

Briefly stated, the drain device of my invention comprises a flanged fitting means having a central drain passage formed therein. The drain passage is adapted to pass through a hole formed in the pool cover with the flanged fitting means placed in sealable engagement with opposed upper and lower surfaces of said cover. Tube means communicate with the drain passage of the flanged fitting and extends upwardly a distance from the flanged fitting, terminating at an inlet end. A drain closure head having a plurality of drain orifices therethrough is fitted around the inlet end of the tube means. A flexible conduit communicates at a first end with the drain passage of the flanged fitting means and is adapted to communicate at a second end with a conventional pool installed sidewall port such as a pump return port in the swimming pool sidewall. The second end of the flexible conduit is secured as by threading to the threaded fitting of the conventional sidewall port. In use, water accumulating on the pool cover above the inlet end of the tube means, or above the inlet orifices of the drain closure head, flows into said tube means inlet end, through the tube means and then through the flexible conduit. The water from the flexible conduit exits the pool through the sidewall port for final discharge by a suitable hose, sump drain, or the like. In one presently preferred embodiment of the invention the drain closure head is vertically adjustable on the tube means to effectively regulate the height between the inlet orifices of the head closure and the pool cover so as to regulate the amount of non-drained water left on the cover for hold-down purposes.

DETAILED DESCRIPTION OF THE INVENTION

Figure 1:
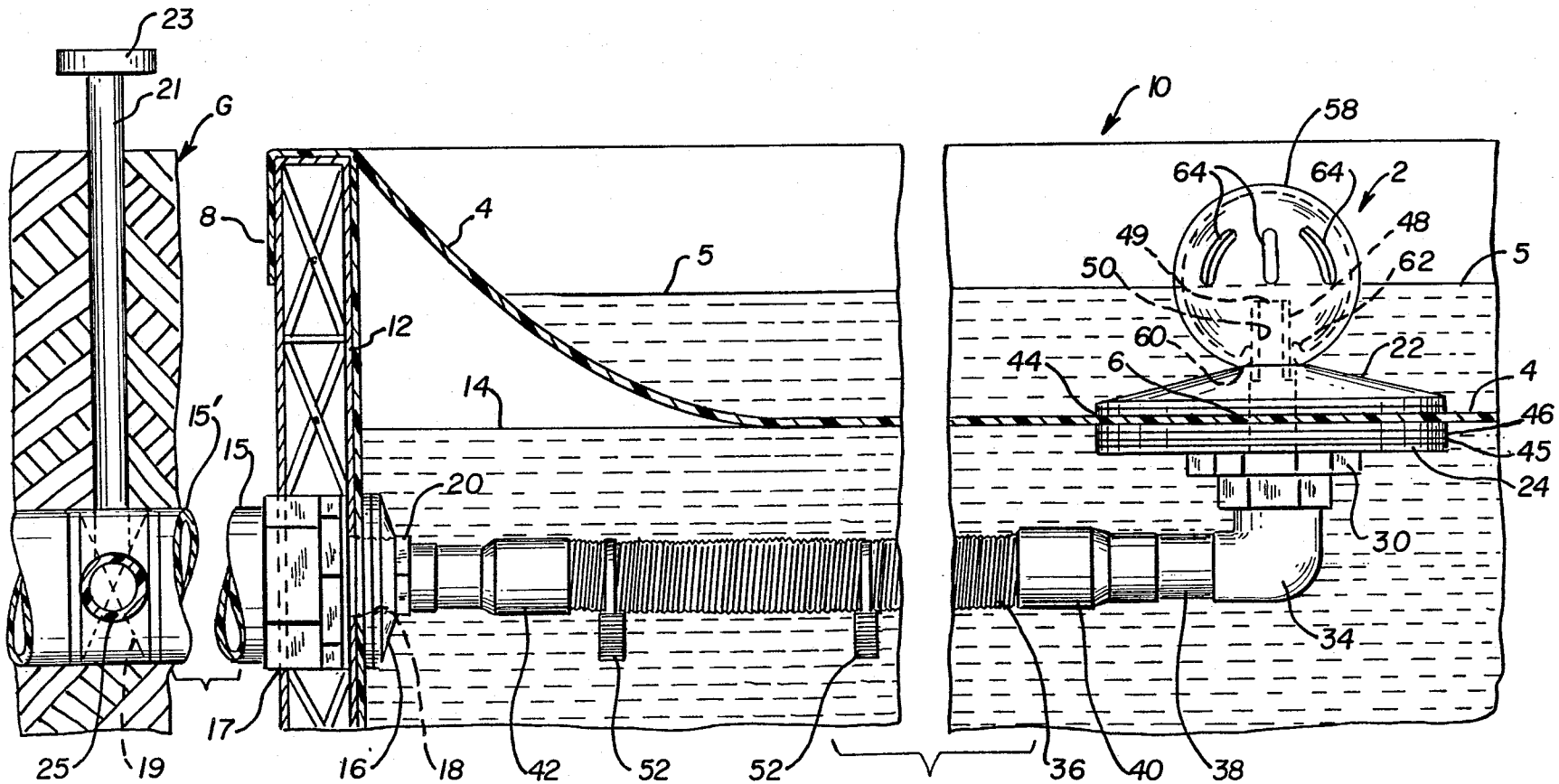
FIG. 1 is a partially fragmented side elevation view of my invention shown installed on a pool cover with the drainage conduit attached to a return port on the pool sidewall.

Referring now to the drawings, a presently preferred embodiment of a swimming pool cover drain device according to my invention is shown in an installed condition and identified generally by the reference numeral 2. The drain device 2 is shown installed on a conventional swimming pool cover 4 of a flexible, water-impervious material such as vinyl or other plastic material. The cover 4 has a hole 6 cut in a central region thereof to permit insertion and installation of the drainage device 2 therein, which will be explained in greater detail hereinafter.

The peripheral edge regions 8 of the pool cover 4 are affixed to the perimeter of the swimming pool 10 by weights, clamps or the like, all in a known manner. The pool 10 may be an above-ground type pool design, as shown in FIG. 1, or it may be an in-ground construction. Both types of pool designs and/or combinations thereof are suitable for use with my invention. The pool 10 includes a sidewall 12 which contains a large volume of clean water 14 which is stored therein during the winter months. A conventional water return fitting or port 16 communicates by way of a suitable conduit 15 with a conventional pump and filter unit (not shown) when the pool is in use. During such normal swimming periods, the return fitting 16 emits filtered water to the pool through a directional nozzle (not shown) which is secured within a threaded bore 18 formed in the return fitting 16. The directional nozzle is easily removed from the bore 18 and a threaded discharge fitting 20 of the drainage device 2 is threadably inserted therein when the invention is to be placed in use, the details of which will be explained hereinafter.

The drainage device 2 is installed on the pool cover 4 in a rather simple and efficient manner prior to placing the cover on the pool and does not require skilled labor to accomplish. The drainage device 2 includes an upper flange 22 and a lower flange 24 having axially aligned central bores 26 and 28, respectively, formed therethrough. The flanges 22 and 24 preferably are of a relatively large diameter, for example between about 8 to 12 inches, so as to provide a stable bearing surface on the cover 4 in order to maintain the flanges in a horizontal position as shown in the drawings. The lower flange includes a downwardly extending, ring-shaped nut portion 30 which is threadably fitted to a threaded collar 32 positioned at an upper end of an elbow shaped fitting 34. The lower end of the elbow fitting 34 is connected to a first end of a length of conduit 36, such as conventional flexible plastic pipe, by way of suitable conventional fittings 38 and 40. The flexible conduit 36 is connected at its second or terminal end to an appropriate fitting 42 which is attached to the discharge port fitting 20. The conduit 36, if constructed of light weight flexible pipe, may tend to float and therefore may require additional weights 52 attached thereto in order to maintain its desired position below the surface of the pool water 14. Of course, heavier more rigid plastic pipe may be used for the conduit 36 in place of flexible pipe, if desired. The fittings 38, 40, 42 are either conventional threaded plastic pipe fittings, or they may be smooth-walled fittings which are secured by cement, or combinations of each. The size of the plastic pipe suitable for use in connection with the invention is, for example, between one to two inches in diameter which is readily available commercially.

As previously stated, the drain device 2 of my invention is suitable for use on both above-ground pools 10, as shown in FIG. 1, or it may be used in connection with in-ground pool designs. As shown in FIG. 1, the conventional water return port fitting 16 is secured within the sidewall 12 of the pool. During the swimming season the port 16 receives filtered water from a pump-filter unit by way of a conventional return pipe or conduit 15. In such above-ground pools, in order to convert to the winter drain mode, the conduit 15 may simply be removed from the exposed fitting 17 at the outer pool sidewall and the drain water from the device 2 is permitted to either drain directly from the fitting 17 to the ground or a drain hose may be fitted thereto and the water is directed to an appropriate drain area such as a gravel sump, storm sewer or the like. Naturally, in most in-ground pools, direct access to the return fitting and return pipe at the outside pool sidewall is not possible since these components are buried. In such situations, a valve arrangement can be employed as shown on the left-hand portion of FIG. 1. The underground return conduit 15' which is buried in ground G, connects the pump-filter unit with the water return fitting 16 and is equipped with an in-line valve 19. The valve 19 is preferably turned by a manually operated shaft 21 having a gripping handle 23 located above ground level. In an open position during the swimming season, valve 19 permits filtered pool water to flow between the pump-filter unit to the return port 16. During the non-swimming winter months, when the device 2 is in use on the covered pool, the valve 19 is moved by turning the shaft 21 to a closed position. This directs the water exiting the return port fitting 16 from device 2 to a drain conduit 25. Drain conduit 25 communicates with conduit 15' at the junction of the valve 19 and preferably extends to a drain field to discharge the excess water received from the drain device 2.

The flanged elements 22 and 24 have ring-shaped rubber sealing washers 44 and 46 adjacent respective flanges to engage the upper and lower surfaces of the pool cover 4 surrounding the hole 6 therein. As the locking nut 30 is threadably rotated in an upward direction, the flanges 22, 24 compressively engage the rubber washers 44, 46 to form a water-tight seal around the hole 6 in the cover. A non-deformable low friction gasket ring 45 is also preferably positioned between the bearing surface of nut 30 and rubber washer 46 to permit firm torquing of the nut 30. The compression seal between the flanges 22, 24, rubber washers 44, 46 and cover 4, prevents accumulated water 5 on the cover from leaking through the hole 6 and into the pool water 14.

The drainage device 2 includes a vertical drain tube 48 having a top edge 49 which preferably extends upwardly a distance from the flange 22. The drain tube 48 has a bore 50 which communicates with flange bore 26, which, in turn, communicates with the bore 35 of the elbow 34 and the bore of the flexible conduit 36. Thus, in the installed state, the bore 50 of the tube 48 permits accumulated water 5 at a level above the top edge 49 of the drain tube 48 to flow into the tube bore 50 and drain through the flexible conduit 36 to be discharged from the pool through the return fitting port 16

The drain tube 48 may be molded as an integral part with the upper flange 22, as shown, or it may be a separate piece and threadably or adhesively secured thereto, for example. A shoulder 54 is formed at the interface of the drain tube 48 and the flange 22 to define a stop surface for a drain closure member 58. The drain closure member 58 is hollow and made of a water-impervious material, such as plastic. The closure member has a hole 60 formed through a lower surface area which is fitted around the drain tube 48. An upwardly extending flap 62 of sidewall preferably surrounds the hole 60 to form a bearing surface between the closure member 58 and the drain tube 48 to stabilize the fit therebetween. The hollow closure member 58 has at least one and preferably a plurality of drain orifices 64 formed around an upper hemispheric surface thereof to permit excess accumulated water to flow therethrough into the interior of the closure member 58 and thence to the drain tube 48. As can be appreciated, the drain orifices provide limited entry ports for water drainage purposes and prevent accumulated debris such as leaves, twigs and the like from blocking the bore 50 of the drain tube 48. A screen may also be placed at inlet 49 of drain tube 48 to further prevent blockage of bore 50 by smaller objects which might pass through the slotted orifices 64.

The surface 62 around hole 60 in the closure member 58 may be permanently secured to the tube 48 by a solvent or cement or by way of a threaded joint. In addition, member 58 may be merely affixed to the drain tube 48 simply by a non-sealed, interference fit between the flap 62 and the tube 48. Certainly, many variations will occur to persons skilled in the art within the context of my invention.

Figure 2:
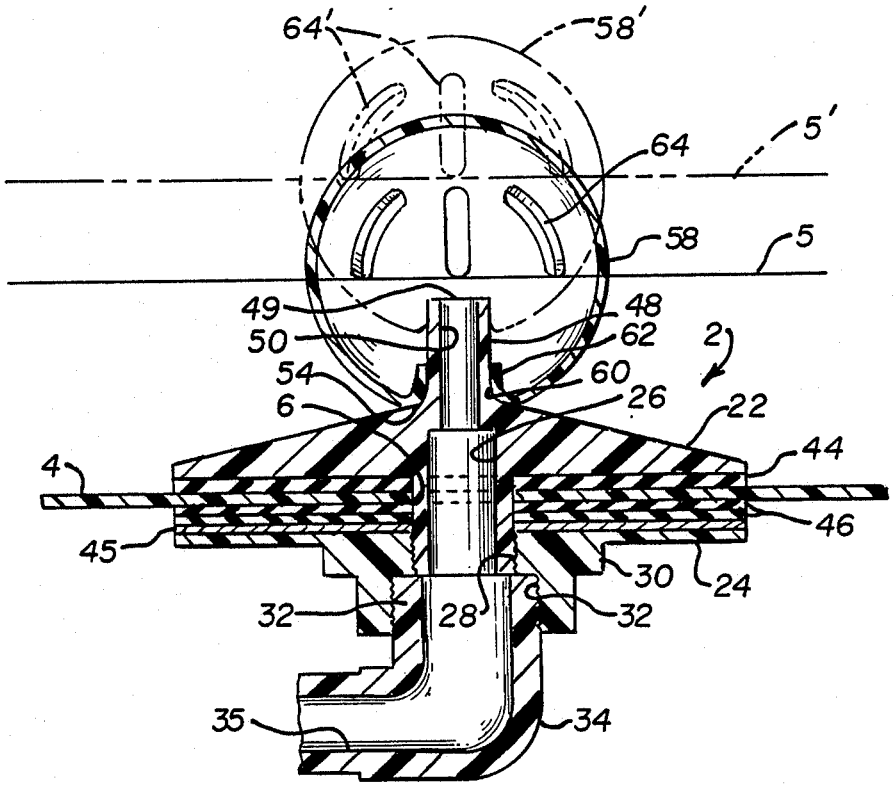
FIG. 2 is a detailed cross-sectional side view of the drainage device depicted in FIG. 1.

The closure member 58 may also be moved vertically along the drain tube 48 as shown in phantom lines in FIG. 2 to permit the pool owner to individually regulate the depth and amount of accumulated water 5 which remains on the pool cover 4 during the winter months. Thus, it the pool cover 4 has a large surface area, it is advantageous to accumulate more water thereon so as to provide a greater weight on the cover to prevent wind whipping of the cover than would be the case with a smaller cover which requires less weight for hold-down purposes. By raising the height of the closure member 58 relative to the upper flange 22, to a position 58', the elevation of the drain orifices 64, is also raised, which provides a greater depth of water 5' to accumulate on the cover prior to entering the orifices 64'. The drain tube 48 can be formed to a length of several inches, e.g. 2–5 inches or more, to provide for adjustability of the closure member therealong. Of course, in this embodiment, the joint area between the flap 62 of the closure member and the drain tube 48 must be sealed to prevent leakage therein and thus short circuit the desired drainage through the orifices 64'.

Figure 3:
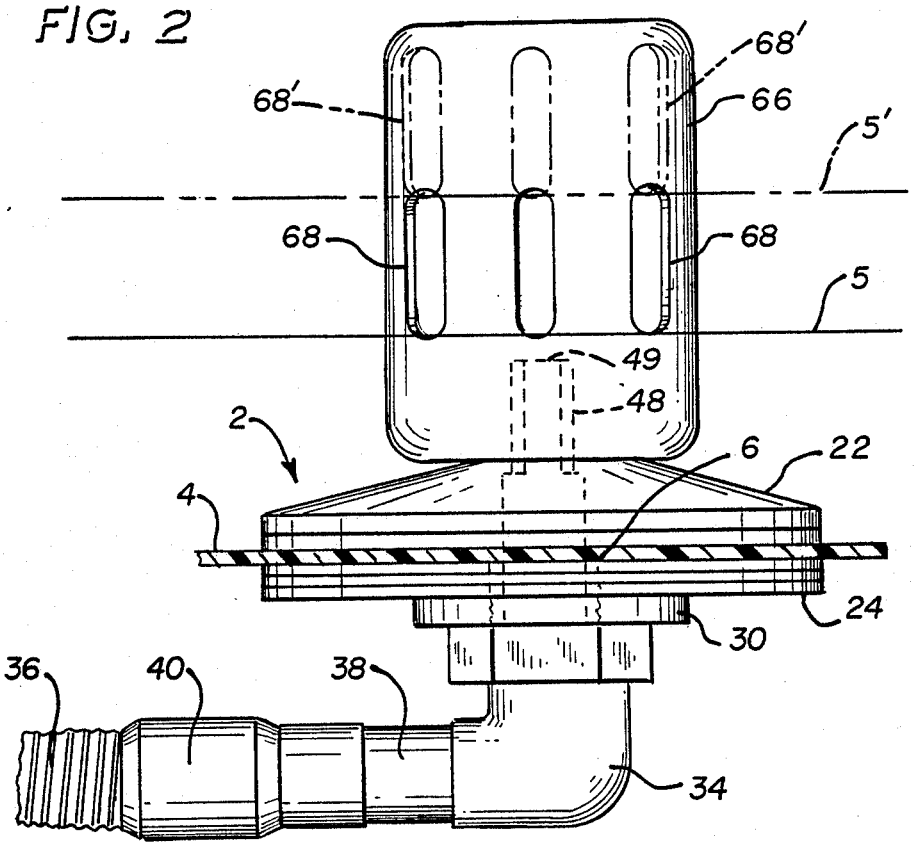
FIG. 3 is a partially fragmented side view of a drainage device of the present invention having a slightly modified drain closure.

The shape of the closure member 58 is shown in FIGS. 1 and 2 as spherical, but it may, of course, be configured in any number of other shapes. An elongated closure member 66 having a cylindrical shape with drain orifices 68 therein is an alternative shape, for example, see FIG. 3. The drain orifices may be formed at a higher elevation on the closure member 66, as shown by phantom lines 68', to allow for a greater depth of water to accumulate on top of the cover if desired.

While several specific embodiments of the invention have been described in detail, it will be appreciated by those skilled in the art that various modifications and alternatives to those details could be developed in light of the overall teachings of the disclosure. Accordingly, the particular arrangements are meant to be illustrative only and not limiting as to the scope of the invention which is to be given the full breadth of the appended claims and any and all equivalents thereof.

What is claimed is:

1. A drain apparatus for a swimming pool cover comprising:

flanged means having a drain passage means formed therethrough, said drain passage means adapted to be placed through a hole formed in said cover and said flange means adapted to be placed in sealable engagement with opposed upper and lower surfaces of said cover surrounding said hole;

tube means communicating with the drain passage means of the flanged means and having an inlet end positioned at a height and spaced above said cover to determine a certain volume of water on said cover for weighting and maintaining said cover on a swimming pool and said drain passage means further including an outlet end positioned below said cover; and conduit means communicating at a first end with the outlet end of the drain passage means of the flanged means and adapted to communicate at a second end with a port in the pool sidewall; whereby, in use, excess accumulated water on said pool cover at a height above the inlet end of the tube means flows into said tube means and is drained from said cover and discharged through said sidewall port.

2. The swimming pool cover drain apparatus of claim 1, wherein said tube means extends upwardly a distance from the flanged means and including closure means fitted on said tube means around the inlet end thereof, said closure means having at least one drain orifice therethrough adapted to permit accumulated water on said pool cover to flow therethrough while blocking entry of accumulated debris therein.

3. The swimming pool cover drain apparatus of claim 2 wherein the closure means is movably fitted on said tube means in a vertical direction to permit the drain orifice to be positioned relative to the inlet end of the tube means at a predetermined elevation, whereby, in use a pre-determined depth of water is permitted to accumulate on said pool cover prior to entering the drain orifice of said closure means.

4. The swimming pool cover drain apparatus of claim 3 wherein the closure means is sphere shaped and has a plurality of spaced-apart drain orifices formed around an upper hemisphere thereof, said closure means also having a mounting hole formed in a lower hemisphere thereof for slidably fitting onto said tube means.

5. The swimming pool cover drain apparatus of claim 2 wherein the closure member is cylinder-like in shape and has a plurality of drain orifices formed around an upper portion thereof.

6. The swimming pool cover drain apparatus of claim 1 wherein the conduit means comprises a length of flexible plastic pipe, including fitting means at said first and second ends adapted for attachment to the flanged means and to the sidewall port, respectively.

7. The swimming pool cover drain apparatus of claim 6 wherein the flexible plastic pipe is fitted with weight means adapted to hold the plastic pipe in a submerged condition.

8. The swimming pool cover drain apparatus of claim 1 wherein the flanged means comprises upper and lower members having flanged surfaces and mating threaded portions for securing said members together in sealable engagement with the cover.

9. The swimming pool cover drain apparatus of claim 8 wherein the tube means and the upper member of the flanged means are formed of an integral molded plastic part.

10. The swimming pool cover drain apparatus of claim 9 including rubber sealing washers interposed between said upper and lower members of said flanged means adapted to sealably engage said pool cover.

11. The swimming pool cover drain apparatus of claim 8 wherein the flanged surfaces of the flanged means have a diameter of between about 8 to 12 inches.

12. A method for draining excess accumulated water from a swimming pool cover comprising:

providing a hole through the pool cover;

affixing a drain means around the hole in the cover, said drain means having a through passage with an inlet end positioned at a height and spaced above said cover to determine a certain volume of water on said cover for weighting and maintaining said cover on a swimming pool and an outlet end positioned below said cover;

affixing a first end of a conduit to the outlet end of the drain means; and affixing a second end of the conduit to a sidewall return port of the swimming pool, whereby, excess water accumulating on the cover at an elevation above the inlet end of the drain means flows into said inlet end and is discharged through said sidewall return port.

* * * * *

UNITED STATES PATENT AND TRADEMARK OFFICE

CERTIFICATE OF CORRECTION

PATENT NO. : 4,819,681

DATED : April 11, 1989

INVENTOR(S) : Frank J. Hodak

It is certified that error appears in the above-identified patent and that said Letters Patent is hereby corrected as shown below:

Column 5 Line 38 "it" should read --if--.

Column 5 Line 45 "64" should read --64'--.

Signed and Sealed this

Fourteenth Day of November, 1989

*Attest:*

JEFFREY M. SAMUELS

*Attesting Officer*

*Acting Commissioner of Patents and Trademarks*